US009145009B2

(12) United States Patent
Takahashi

(10) Patent No.: US 9,145,009 B2
(45) Date of Patent: Sep. 29, 2015

(54) PRINT LABEL PRODUCING APPARATUS AND CUTTING BLADE RECEIVING MEMBER

(71) Applicant: Toshihiro Takahashi, Nagoya (JP)

(72) Inventor: Toshihiro Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/929,339

(22) Filed: Jun. 27, 2013

(65) Prior Publication Data

US 2013/0287467 A1 Oct. 31, 2013

(30) Foreign Application Priority Data

Mar. 28, 2011 (JP) ..... 2011-069420

(51) Int. Cl.

| | |
|---|---|
| ***B41J 11/00*** | (2006.01) |
| ***B41J 11/70*** | (2006.01) |
| ***B26D 1/08*** | (2006.01) |
| ***B26D 3/08*** | (2006.01) |
| ***B26D 3/12*** | (2006.01) |
| *B26D 5/10* | (2006.01) |

(Continued)

(52) U.S. Cl.

CPC ..... *B41J 11/70* (2013.01); *B26D 1/085* (2013.01); *B26D 3/085* (2013.01); *B26D 3/12* (2013.01); *B41J 11/703* (2013.01); *B26D 5/10* (2013.01); *B26D 7/20* (2013.01); *B26D 2007/005* (2013.01)

(58) Field of Classification Search

CPC ..... B26D 2007/005; B41J 11/703

USPC ..... 400/621

See application file for complete search history.

(56) References Cited

U.S. PATENT DOCUMENTS

RE32,490 E * 9/1987 Jenkins ..... 156/250
5,271,789 A * 12/1993 Takagi et al. ..... 156/387

(Continued)

FOREIGN PATENT DOCUMENTS

JP 4141466 A 5/1992
JP 11170638 A 6/1999

(Continued)

OTHER PUBLICATIONS

International Preliminary Report on Patentability issued in Application No. PCT/JP2012/057637 on Oct. 10, 2013.

(Continued)

*Primary Examiner* — Anthony Nguyen

(74) *Attorney, Agent, or Firm* — McCarter & English, LLP

(57) ABSTRACT

This disclosure discloses a print label producing apparatus comprising an apparatus main body, and a cutting blade receiving member, the apparatus main body comprising a feeder, a printing head, a cutting blade configured to press and cut a print-receiving tape, and a holding portion configured to attach and detach the cutting blade receiving member, and the cutting blade receiving member comprises a first cutting blade receiving member comprising at least one concave portion configured to receive at least a part of the print-receiving tape, and a first contact portion configured to receive and stop the cutting blade, disposed at the adjacent position from the concave portion, and a second cutting blade receiving member comprising a second contact portion configured to receive and stop contact of the cutting blade, and the holding portion is configured to permit selective mounting of one of the first and second cutting blade receiving member.

14 Claims, 18 Drawing Sheets

(51) Int. Cl.

| | |
|---|---|
| *B26D 7/20* | (2006.01) |
| *B26D 7/00* | (2006.01) |

(56) References Cited

U.S. PATENT DOCUMENTS

| | | | | | |
|---|---|---|---|---|---|
| 5,458,423 | A * | 10/1995 | Sims et al. | 400/621 |
| 5,813,305 | A * | 9/1998 | Miazga et al. | 83/508 |
| 5,839,840 | A * | 11/1998 | Kawano | 400/621 |
| 5,957,597 | A * | 9/1999 | Kato | 400/621 |
| 6,113,294 | A * | 9/2000 | Niwa | 400/621 |
| 6,341,548 | B1 * | 1/2002 | Hirahata et al. | 83/881 |
| 7,021,845 | B2 * | 4/2006 | Kondo | 400/88 |
| 8,393,811 | B2 * | 3/2013 | Jo et al. | 400/621 |
| 8,672,565 | B2 * | 3/2014 | Vandermeulen | 400/88 |
| 2002/0067943 | A1 * | 6/2002 | Furuya et al. | 400/621 |
| 2005/0061132 | A1 * | 3/2005 | Sodeyama | 83/694 |
| 2006/0133882 | A1 * | 6/2006 | Adams et al. | 400/621 |

FOREIGN PATENT DOCUMENTS

| | | | |
|---|---|---|---|
| JP | 11277820 | A | 10/1999 |
| JP | 200596103 | A | 4/2005 |
| JP | 2010211634 | A | 9/2010 |

OTHER PUBLICATIONS

PCT International Search Report for PCT/JP2012/057637 mailed on May 29, 2012.

* cited by examiner

PRINT LABEL PRODUCING APPARATUS AND CUTTING BLADE RECEIVING MEMBER

CROSS-REFERENCE TO RELATED APPLICATION

This is a CIP application PCT/JP2012/057637, filed Mar. 23, 2012, which was not published under PCT article 21(2) in English.

BACKGROUND

1. Field

The present disclosure relates to a print label producing apparatus that produces print labels, and a cutting blade receiving member used in the same.

2. Description of the Related Art

There are known print label producing apparatuses that feed a print-receiving tape, cut the tape at a desired length, and produce a print label. According to this print label producing apparatus of prior art, a print-receiving tape on which printing was performed by printing means is fully cut in a thickness direction by a cutter, thereby producing a print label. According to this print label producing apparatus of prior art, in order to perform cutting of a desired mode other than the full cutting (hereinafter suitably referred to as "desired cutting"; half cutting in this example), a half-cutter capable of partially cutting the print-receiving tape in the thickness direction is provided.

According to the prior art, both means (a cutter) for performing regular full cutting and means (a half-cutter) for performing desired cutting are separately provided, leading to problems such as difficulties in decreasing the apparatus size and increases in manufacturing costs.

SUMMARY

It is therefore an object of the present disclosure to provide a print label producing apparatus capable of executing both full cutting and desired cutting of another mode on the print-receiving tape without leading to increases in the apparatus size or manufacturing costs, and a cutting blade receiving member used in the same.

In order to achieve the above-described object, according to the aspect, there is provided a print label producing apparatus comprising a print label producing apparatus main body, and at least one cutting blade receiving member configured to receive and stop a cutting blade when a print-receiving tape is cut by the cutting blade, the print label producing apparatus main body comprising a feeder configured to feed the print-receiving tape along a feeding path, a printing head configured to perform desired printing on the print-receiving tape fed by the feeder, the cutting blade configured to move along a direction orthogonal to the feeding path and press and cut the print-receiving tape after printing, and a holding portion configured to attach and detach the cutting blade receiving member, and the at least one cutting blade receiving member comprises a first cutting blade receiving member comprising at least one concave portion configured to receive at least a part of an entire tape width of the print-receiving tape in a tape thickness direction, and a first contact portion configured to receive and stop contact of a blade edge of the cutting blade at an adjacent position, disposed at the adjacent position along the tape width direction from the concave portion, and a second cutting blade receiving member comprising a second contact portion configured to receive and stop contact of the blade edge of the cutting blade while sandwiching the entire tape width of the print-receiving tape, and the holding portion of the print label producing apparatus main body is configured to permit selective mounting of one of the first cutting blade receiving member and the second cutting blade receiving member.

According to the print label producing apparatus of the present disclosure, the print-receiving tape is fed by feeding means and, after desired printing is performed by printing means on the fed print-receiving tape, the print-receiving tape is cut using a cutting blade. When the print-receiving tape is cut, the cutting blade moves in a direction orthogonal to the feeding path, and is received and stopped by a cutting blade receiving member mounted to a holding portion.

In the present disclosure, two types of cutting blade receiving members are selectively mounted to the holding portion: a first cutting blade receiving member and a second cutting blade receiving member. The second cutting blade receiving member comprises a second contact portion and, at the time of the cutting operation of the cutting blade, this second contact portion receives and stops the contact of the blade edge of the cutting blade while sandwiching the entire tape width of the print-receiving tape. With this arrangement, in a case where the second cutting blade receiving member is mounted to the holding portion, the cutting blade can fully cut the print-receiving tape in the thickness direction.

The first cutting blade receiving member comprises at least one concave portion and a first contact portion. The concave portion receives at least a part of the entire tape width of the print-receiving tape in the tape thickness direction. The first contact portion is disposed at a position adjacent of the concave portion along the tape width direction, and receives and stops the blade edge of the cutting blade. With this arrangement, in a case where the first cutting blade receiving member is mounted to the holding portion, the cutting blade fully cuts the area of the print-receiving tape corresponding to the first contact portion in the thickness direction. On the other hand, since the blade edge of the cutting blade does not fully arrive at the area of the print-receiving tape received by the concave portion, the cutting blade is capable of partially cutting (so-called half cutting) or not cutting the print-receiving tape in the thickness direction.

As described above, in the present disclosure, it is possible to perform regular full cutting of the print-receiving tape when the second cutting blade receiving member is mounted, and it is possible to perform cutting of an intended desired mode (desired cutting), such as half cutting (or not cutting) at least a part of the print-receiving tape when the first cutting blade receiving member is mounted. That is, by simply replacing the cutting blade receiving member mounted to the holding portion, it is possible to execute both full cutting and desired cutting using the same single cutting blade. With this arrangement, compared to the prior art structure which requires provision of both a cutting device for full cutting and a cutting device for desired cutting, it is possible to decrease the size as well as the manufacturing costs of the apparatus.

BRIEF DESCRIPTION OF THE DRAWINGS

FIG. 4 is a plan view showing the internal structure of the cartridge along with the roller holder, rib, heat sink, thermal head, and the like.

DETAILED DESCRIPTION OF PREFERRED EMBODIMENTS

Figure 1:
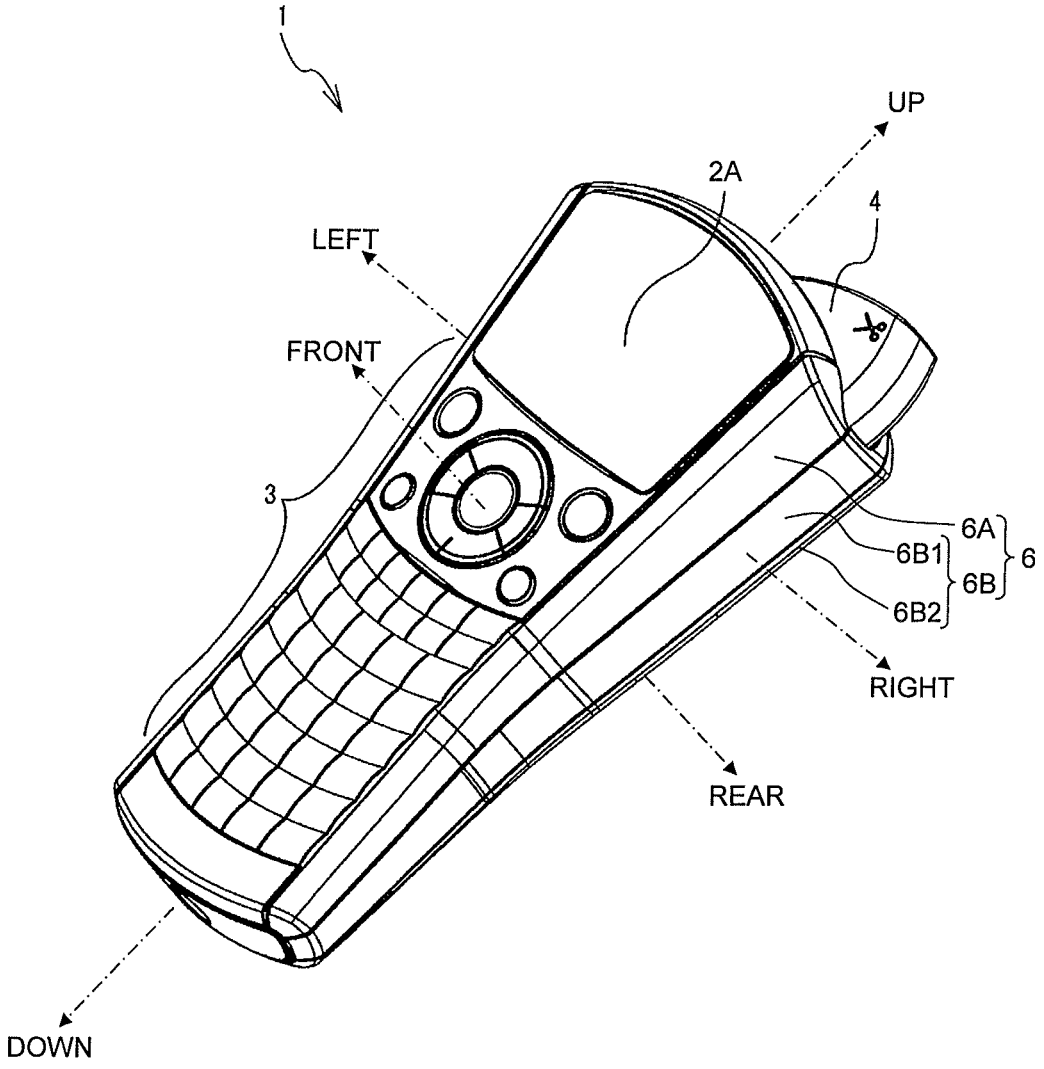
FIG. 1 is a perspective view showing the overall configuration of the print label producing apparatus of an embodiment of the present disclosure.

The following describes one embodiment of the present disclosure with reference to accompanying drawings. Note that, in a case where "Front," "Rear," "Left," "Right," "Up," and "Down" are denoted in the drawings below, the terms front, rear, left, right, up, and down in the explanations within the description refer to the denoted directions.

General Outer Structure of Apparatus

As shown in FIG. 1, a print label producing apparatus 1 is a handheld print label producing apparatus gripped in the hand of an operator. A housing 6 of this print label producing apparatus 1 comprises a front cover 6A that constitutes the apparatus front surface, and a rear cover 6B that constitutes the apparatus rear surface. Furthermore, this rear cover 6B comprises a rear cover main body 6B1 having various built-in mechanisms, and a detachable cover 6B2 that can be removed from the rear cover main body 6B1 when attaching or detaching a cartridge 31 or a dry battery 8 (refer to FIG. 2 described later for both).

A liquid crystal display part (not shown) for displaying print data, setting screens, and the like is disposed at the upper side of the above described front cover 6A. The front surface of this liquid crystal display part is covered by a cover panel 2A, which is a transparent acrylic plate, etc., for example. A keyboard part 3 for operating the print label producing apparatus 1 is provided below the liquid crystal display part. This keyboard part 3 includes character keys of characters, symbols, numbers, and the like, and various function keys. A cut lever 4 for cutting a label tape 80 with print (refer to FIG. 4 described later) is disposed at the upper right end of the above described rear cover main body 6B1.

Internal Structure of Apparatus

Figure 2:
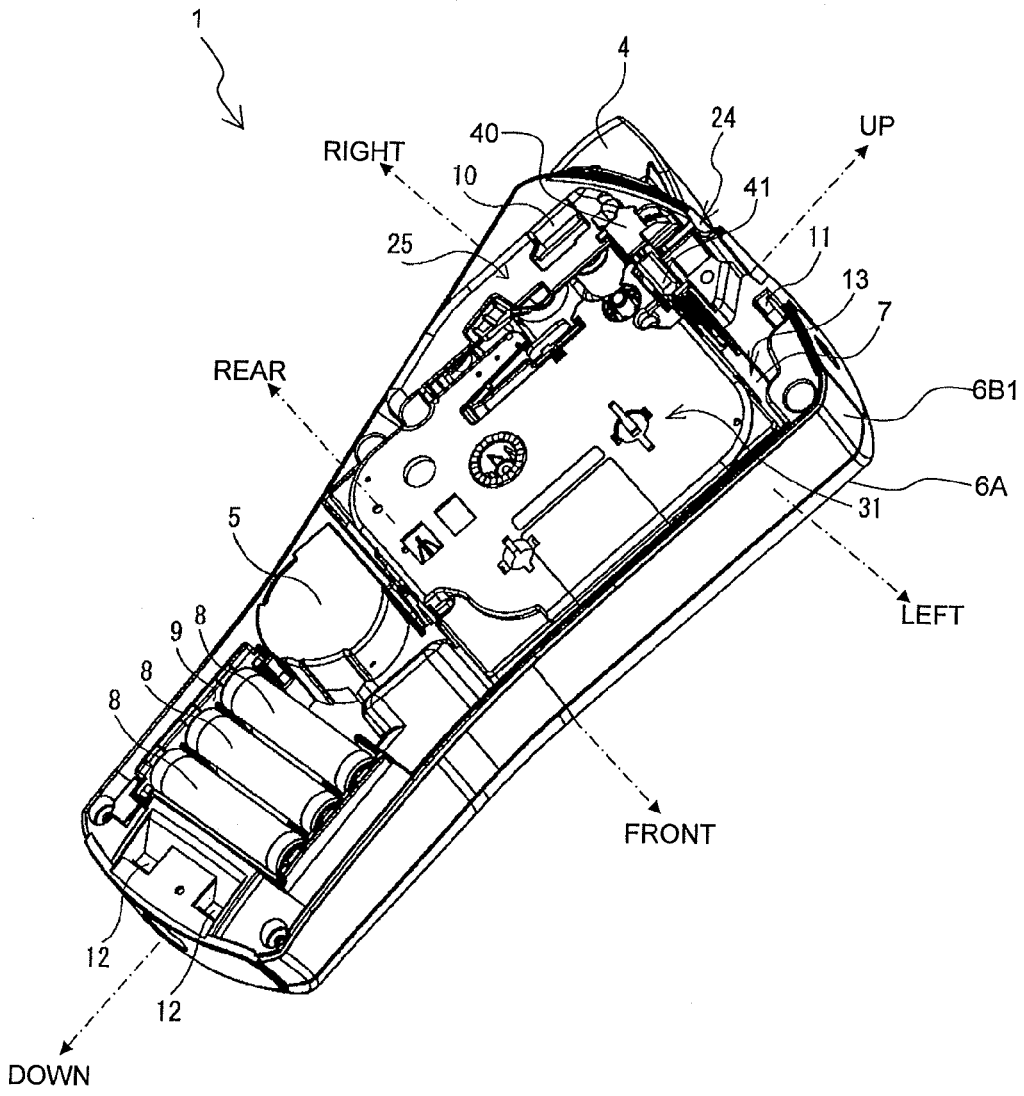
FIG. 2 is a perspective view showing the internal structure of the print label producing apparatus with the detachable cover removed and the cartridge and dry battery mounted to the cartridge holder and battery storage part.
Figure 3:
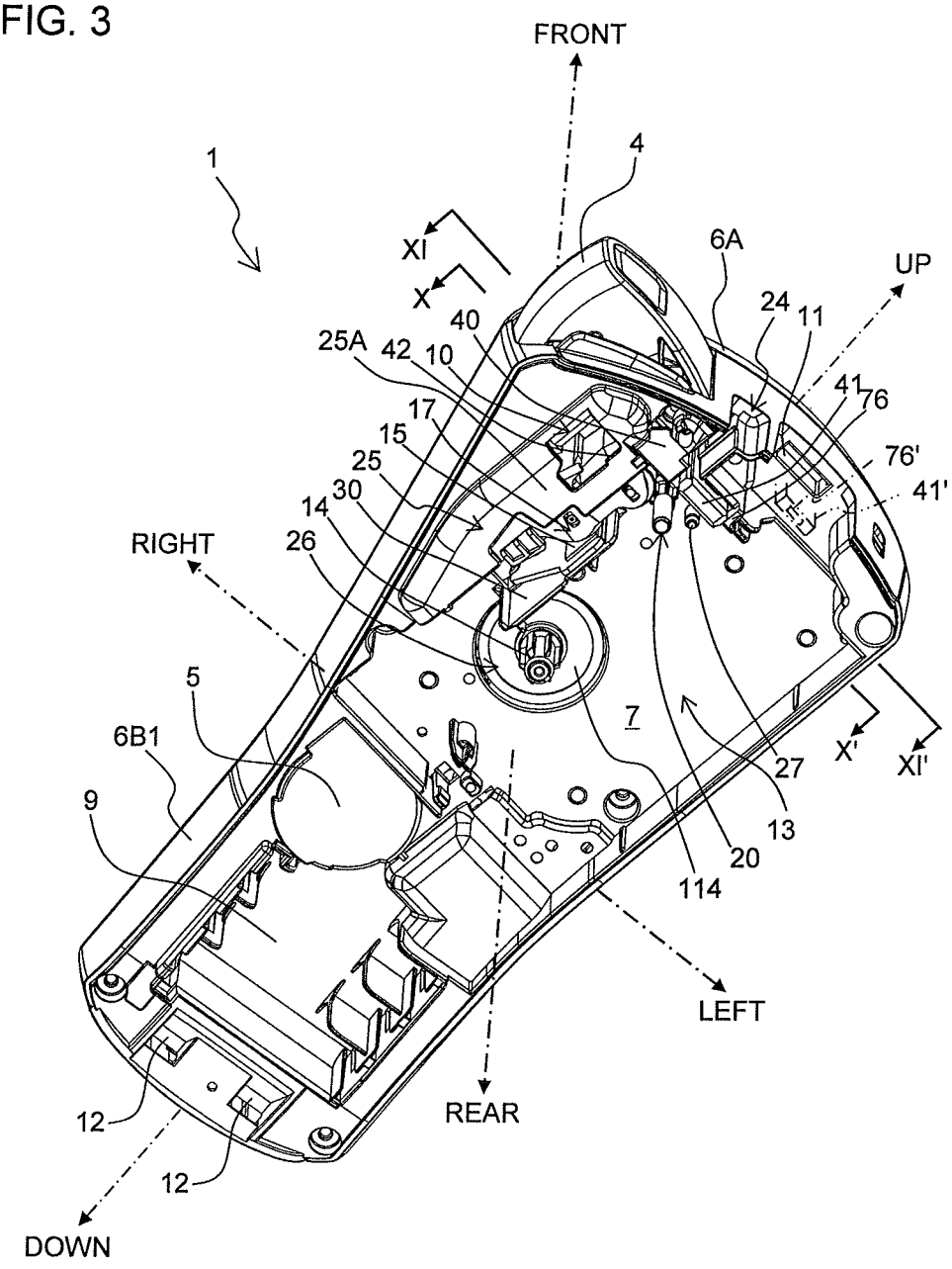
FIG. 3 is a perspective view showing the internal structure of the print label producing apparatus with the detachable cover removed and the cartridge and dry battery removed from the cartridge holder and battery storage part.

The internal structure of the print label producing apparatus will now be described with reference to FIG. 2 and FIG. 3. As shown in FIG. 2 and FIG. 3, a frame 13 formed by resin (synthetic resin, for example) is disposed at the interior of the above described front cover 6A and the above described rear cover main body 6B1. Then, a cartridge holder 7 of a rectangular shape in the planar view, formed in a concave shape for attaching and detaching the cartridge 31, is disposed at the rear upper area of this frame 13.

A motor storage part 5 for storing a motor (not shown) is provided below the cartridge holder 7. A battery storage part 9 for storing a dry battery 8 is provided further below the motor storage part 5.

A tape discharging slit 24 for discharging the label tape 80 with print (refer to FIG. 4 described later) to the outside is formed in the upper area of the above described frame 13. Further, a roller holder 17 (detailed structure described later) is disposed at the upper right area of the frame 13. A plate part 25 comprising a plate shape and made of synthetic resin is disposed at the rear side of the roller holder 17 so as to cover the roller holder 17. Note that this plate part 25 is integrally formed with the frame 13. Furthermore, a protruding part insertion port 10, which is an opening, is disposed at the upper area of this plate part 25. As the above described detachable cover 6B2 is attached and detached to and from the rear cover main body 6B1, a protruding part 45 (refer to FIG. 5 described later) disposed at the detachable cover 6B2 is inserted and removed into and from the protruding part insertion port 10.

A lock hole 11 is disposed at the upper end and two lock holes 12 are disposed at the lower end of the rear cover main body 6B1. When the above described detachable cover 6B2 is installed to the rear cover main body 6B1, lock members 47 and 48 (refer to FIG. 5 described later) disposed at the detachable cover 6B2 are inserted into the lock holes 11 and 12, respectively.

A gear concave portion 26 formed into a concave shape is disposed at the substantial center of the above described frame 13. A gear (not shown) is disposed at the gear concave portion 26, forming a structure wherein the teeth part of the gear is covered by a concealing umbrella part 114 and thus not exposed. Then, a ribbon take-up shaft 14 for taking up an ink ribbon 55 (refer to FIG. 4 described later) is arranged in a standing condition on the rear side of the gear. The above described gear and a plurality of gears (not shown) disposed at the front surface side of the frame 13 that engages therewith are respectively formed by synthetic resin. Further, the gear shaft (not shown) that rotatably supports these gears is also formed by synthetic resin and integrally formed with the frame 13.

A rib 30 is arranged in a standing condition on the right side of the ribbon take-up shaft 14. A heat sink 15, which is a rectangular radiator plate, is disposed at the right side surface of this rib 30. Then, a roller shaft 20 is arranged in a standing condition between the rib 30 and the tape discharging slit 24. This roller shaft 20 is formed by synthetic resin, and is formed integrally with the frame 13. A convex portion 27 is arranged in a standing condition on the left side of the roller shaft 20. This convex portion 27 is inserted into a concave portion (not shown) of the cartridge 31, thereby positioning the cartridge 31 in the front-rear direction.

Further, a guide holder 40 that stores a cutter holder 60 (refer to FIG. 5 described later) comprising a cutter blade 63 (refer to FIG. 11 described later) in its interior is provided near the above described tape discharging slit 24 of the above described frame 13. Furthermore, a cutter blade receiving member 41 is disposed at the left side of the above described guide holder 40, near the above described tape discharging slit 24 of the above described frame 13. This cutter blade receiving member 41 is for receiving and stopping the cutter blade 63 when the cutter blade 63 cuts the label tape 80 with print.

Further, the above described cut lever 4 is pivotably supported by the frame 13 (with a lever shaft 65 described later serving as the axis), making it possible to move the above described cutter blade 63.

Further, as shown in FIG. 3, a first rib 42 and a holding portion 76 are respectively integrally formed with the frame 13 near the above described tape discharging slit 24. The rib 42 formed further on the right side than the tape discharging slit 24 is arranged vertically in a standing condition with respect to a planar rear surface part 25A of the above described plate part 25. On the other hand, the holding portion 76 formed further on the left side than the tape discharging slit 24 is arranged in a standing condition on the left side of the above described cutter blade receiving member 41, and is for holding (installing) the cutter blade receiving member 41.

Cartridge Internal Structure

Figure 4:
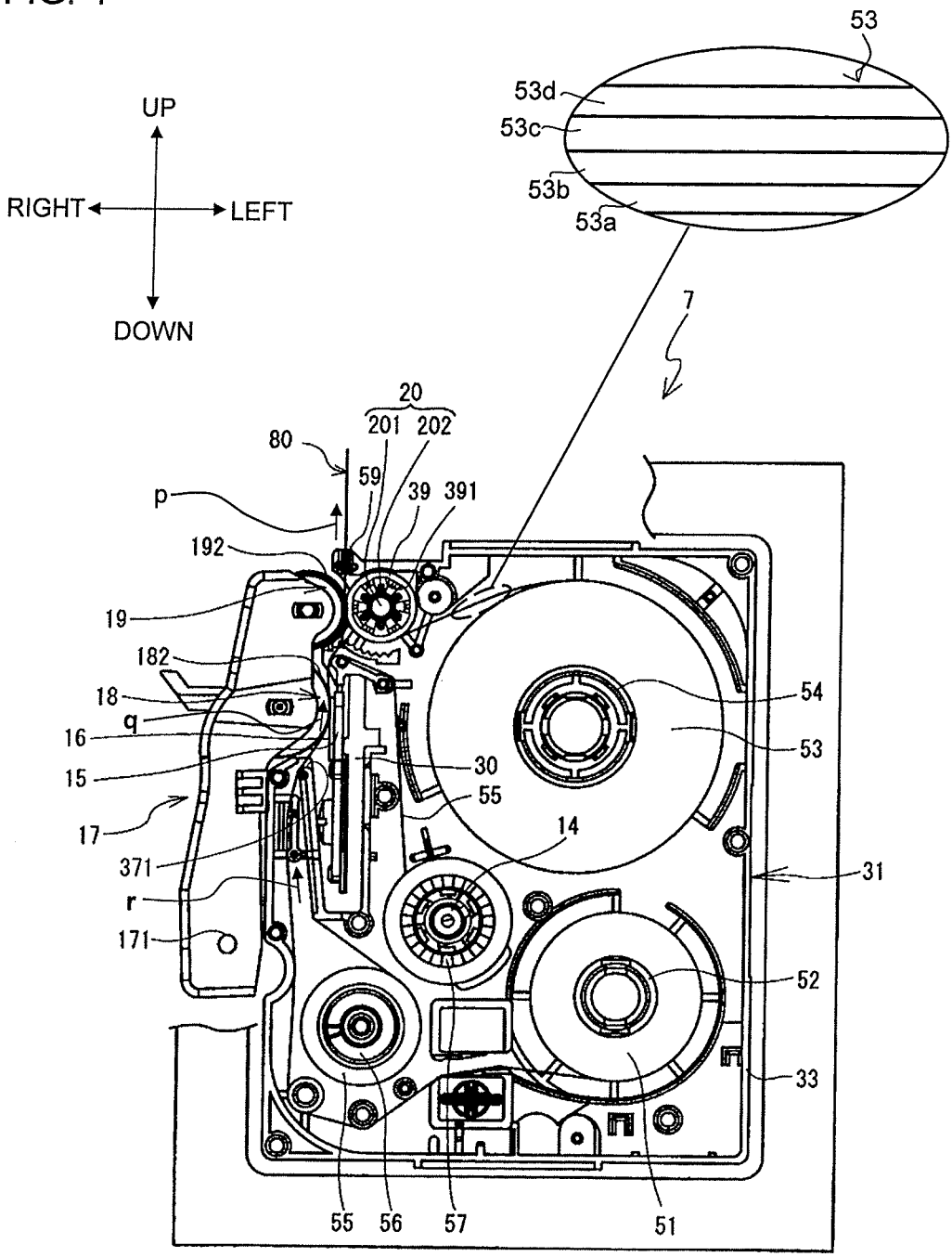

The following describes the internal structure of the cartridge 31 using FIG. 4. As shown in FIG. 4, a cover film spool 52 around which is wound a transparent film-shaped cover film 51 is rotatably disposed in the lower left area inside a cartridge case 33. The cover film 51 fed out from this cover film spool 52 is guided toward a cartridge opening 371, and fed from the cartridge opening 371. A ribbon spool 56 around which is wound the ink ribbon 55 is rotatably disposed in the lower right area inside the cartridge case 33. The ink ribbon 55 fed out from this ribbon spool 56 is guided toward the cartridge opening 371, and fed along with the cover film 51.

A ribbon take-up spool 57 is rotatably disposed between the cover film spool 52 and the ribbon spool 56. This ribbon take-up spool 57 draws the ink ribbon 55 from the ribbon spool 56, taking up the ink ribbon 55 that has been consumed by the printing (print) of characters and the like.

A base tape spool 54 around which is wound a base tape 53 is rotatably disposed in the upper area inside the cartridge case 33. In this example, the base tape 53 has a four-layer structure (refer to the partially enlarged view in FIG. 4) comprising an adhesive layer 53*a* made of a suitable adhesive, a colored base film 53*b* made of PET or the like, an adhesive layer 53*c* made of a suitable adhesive material, and a separation sheet 53*d*. The four layers of the base tape 53 are layered in that order from the side rolled to the radial inside (the lower side in the enlarged view) to the opposite side (the upper side in the enlarged view). The base tape 53 fed out from this base tape spool 54 is guided toward a feeding roller 39 and pressed with the cover film 51 with print by the feeding roller 39 and a pressure roller 192 via the above described adhesive layer 53*a* to form the label tape 80 with print, which is then fed toward a label tape discharging exit 59.

The arm-shaped roller holder 17 comprising a platen roller unit 18 and a pressure roller unit 19 is disposed at the right side of the cartridge 31 mounted to the cartridge holder 7 so that it is rockable in the left-right direction around a shaft support part 171. This roller holder 17, similar to the above described frame 13, is also made of synthetic resin. When the above described detachable cover 6B2 is installed, the roller holder 17 is moved in the direction of the cartridge 31 by the protruding part 45 (refer to FIG. 5 described later). With this arrangement, the pressure roller unit 19 and the platen roller unit 18 disposed at the roller holder 17 move to the printing position (the position shown in FIG. 4).

The above described platen roller unit 18 is disposed on the right side of the heat sink 15. A platen roller 182 and the platen roller gear (not shown) are disposed at the platen roller unit 18. The platen roller 182 is disposed in a position facing a thermal head 16 disposed at the right side surface of the heat sink 15. The thermal head 16 performs desired printing on the cover film 51 fed along the above described feeding path by the pressure roller 192, the platen roller 182, and the like. The platen roller gear engages with the gear (not shown) disposed at the front side of the frame 13 and, with the power transmitted from a motor, rotates, thereby rotating the platen roller 182. With this arrangement, when the platen roller unit 18 moves to the printing position, the platen roller 182 feeds the cover film 51 on which characters, graphics, symbols, and the like have been printed in the direction of the pressure roller unit 19 by the rotation thereof while pressing the cover film 51 and the ink ribbon 55 against the thermal head 16.

The pressure roller 192 and the pressure roller gear (not shown) are disposed at the pressure roller unit 19. The pressure roller 192 is disposed in a position facing the above described roller shaft 20, and feeds the cover film 51, the base tape 53, and the label tape 80 with print along the feeding path (refer to arrows p, q, and r) toward the above described tape discharging slit 24. The roller shaft 20 comprises a cylinder part 201 formed into a cylindrical shape, and six ribs 202 formed radially from the outer periphery of this cylinder part 201 toward the outside. The roller shaft 20 is inserted into a shaft hole 391 of the feeding roller 39 disposed at the cartridge 31, and rotatably supports the feeding roller 39.

The pressure roller gear engages with the gear (not shown) disposed at the front side of the above described frame 13 and, with the power transmitted from the motor, rotates, thereby rotating the pressure roller 192. With this arrangement, when the pressure roller unit 19 moves to the printing position, the pressure roller 192 presses the cover film 51 and the base tape 53 against the feeding roller 39 rotatably supported by the roller shaft 20. With this arrangement, the cover film 51 on which printing was performed and the base tape 53 are pressed, thereby forming the label tape 80 with print, which is then discharged from the above described label tape discharging exit 59. The subsequent feeding path of the label tape 80 with print (in other words, the feeding path of the cover film 51; hereinafter the same) upwardly feeds the label tape 80 with print between the above described guide holder 40 and the above described cutter blade receiving member 41 (refer to FIG. 2, etc.) by the pressure roller 192, etc., guiding the label tape 80 with print to the above described tape discharging slit 24, and discharges the label tape 80 with print from the tape discharging slit 24 to outside the print label producing apparatus 1. Subsequently, the cutter blade 63 cuts (or half-cuts; details described later) the label tape 80 with print. When the label tape 80 with print is cut, the cutter blade 63 moves in a direction (direction C in FIG. 11 described later) orthogonal to the feeding path and is received and stopped by the cutter blade receiving member 41 mounted to the above described holding portion 76, thereby performing the above-described cutting (or half cutting).

Detachable Cover

Figure 5:
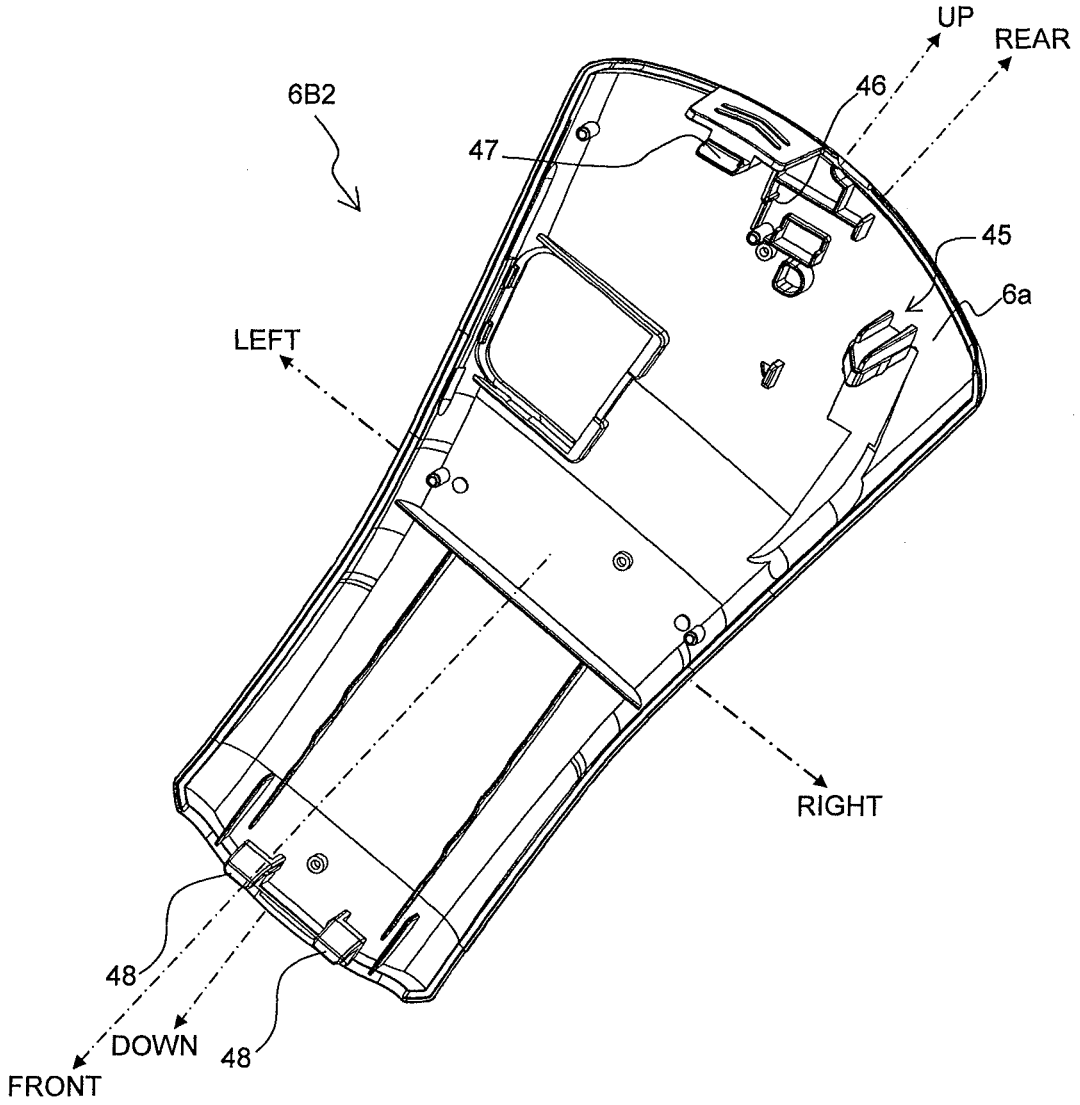
FIG. 5 is a perspective view showing the front surface of the detachable cover.

The following describes the detachable cover 6B2 using FIG. 5. As shown in FIG. 5, the aforementioned lock member 47 is arranged in a standing condition on the upper left end of the front surface 6*a* of the detachable cover 6B2, and two of the aforementioned lock members 48 are arranged in a standing condition on the lower end. When the detachable cover 6B2 is installed to the above described rear cover main body 6B1, these lock members 47 and 48 are respectively inserted into the lock holes 11 and 12 (refer to FIG. 2, etc.) disposed at the above described rear cover main body 6B1. With this arrangement, natural release of the detachable cover 6B2 is prevented.

Then, the detachable cover 6B2 is installed to the above described rear cover main body 6B1 (in other words, the frame 13), making it possible to form a mechanism storage space (i.e., a space produced between the detachable cover 6B2 and the frame 13) that stores the various mechanisms made of the aforementioned pressure roller 192, thermal head 16, cutter blade 63, cutter blade receiving member 41, etc., in coordination with the frame 13.

Further, the protruding part 45 is arranged vertically in a standing condition with respect to the front surface 6*a* of the detachable cover 6B2, in the upper right area of the front surface 6*a* of the detachable cover 6B2. The detachable cover 6B2 is attached and detached to and from the above described rear cover main body 6B1, thereby inserting and removing the protruding part 45 into and from the protruding part insertion port 10 (refer to FIG. 2, etc.) disposed at the above described rear cover main body 6B1. With this arrangement, the above described roller holder 17 can be moved to a printing position (the position shown in FIG. 4) or to a standby position (the position shown in FIG. 3). The protruding part 45 is capable of supporting the rib 42 (refer to FIG. 3) integrally formed with the frame 13 from the right side of the rib 42 in a state where the detachable cover 6B2 is installed to the above described rear cover main body 6B1 (in other words, installed to the frame 13; hereinafter the same).

Further, a support rib 46 is arranged vertically in a standing condition with respect to the front surface 6*a* of the detachable cover 6B2, in the upper area of the front surface 6*a* of the detachable cover 6B2. The support rib 46 is capable of supporting the holding portion 76 (refer to FIG. 3) integrally formed with the frame 13 from the left side of the holding portion 76, in a state where the detachable cover 6B2 is installed to the above described rear cover main body 6B1. Note that, in a case where a reaction force from the label tape 80 with print is adequately tolerable by the holding portion 76 during full cutting or half cutting (described later), the above described support rib 46 may be omitted.

In the above, the greatest characteristic of this embodiment lies in the capability of respectively executing both regular full cutting as well as half cutting (described later) on the label tape 80 with print by the mounting of one common cutter blade receiving member 41 having a different shape on one side and the other side to the holding portion 76, while switching the orientation. In the following, details on the functions will be described in order.

Structure of Cutter Blade Receiving Member and Holding Portion

Figure 6:
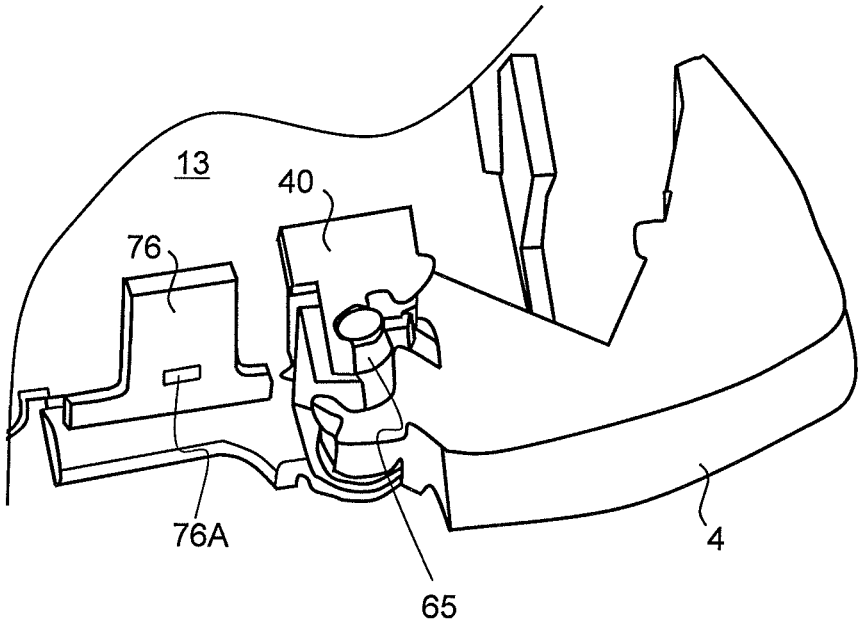
FIG. 6 is an enlarged perspective view showing the structure near the holding portion, with the cutter blade receiving member removed.

The following describes the detailed structure of the cutter blade receiving member 41 and the holding portion 76 using FIGS. 6-8, etc.

In FIG. 6, as previously described, the holding portion 76 of a rectangular plate shape in this example is arranged in a standing condition (integrally with the frame 13) on the left side of the tape discharging slit 24. On the other hand, the cutter blade receiving member 41 in this example, as shown in FIG. 7 and FIG. 8, is formed into a square bag shape and freely detachably fit to and held by the holding portion 76 (refer to FIG. 6) via an insertion hole 74 formed on the bottom area.

At this time, a locking hole 76A (refer to FIG. 6) of an oblong rectangular shape is provided across both the front and rear surfaces of the holding portion 76. To correspond with this locking hole 76A, the cutter blade receiving member 41 comprises elastic hook pieces 75 provided in an protruding manner so as to oppose each other on the insertion hole 74 side of the cutter blade receiving member 41 (i.e., protruding vertically downward on each concave inner side formed at the front-rear lower edge center of the insertion hole 74; refer to FIG. 7A and FIG. 7B). With this arrangement, when the operator, for example, grips a side surface 70, thereby fitting and attaching the cutter blade receiving member 41 to the holding portion 76, the front-rear pair of elastic hook pieces 75 on the insertion hole 74 side of the cutter blade receiving member 41 engages with and is held by the above described locking hole 76A of the holding portion 76. And, when the operator, for example, grips the side surface 70, thereby forcibly pulling up the cutter blade receiving member 41 from the holding portion 76, the leading edges of the elastic hook pieces 75 ride up the wall surfaces, causing the elastic hook pieces 75 to elastically expand, thereby separating the cutter blade receiving member 41 from the holding portion 76.

Figure 7A:
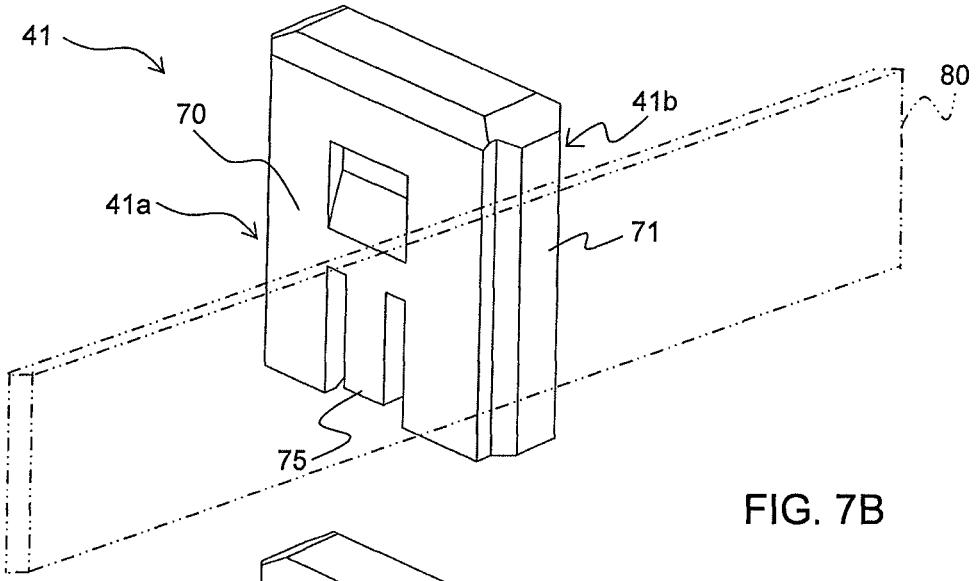
FIG. 7A is a perspective view showing the detailed structure of the cutter blade receiving member.
Figure 7B:
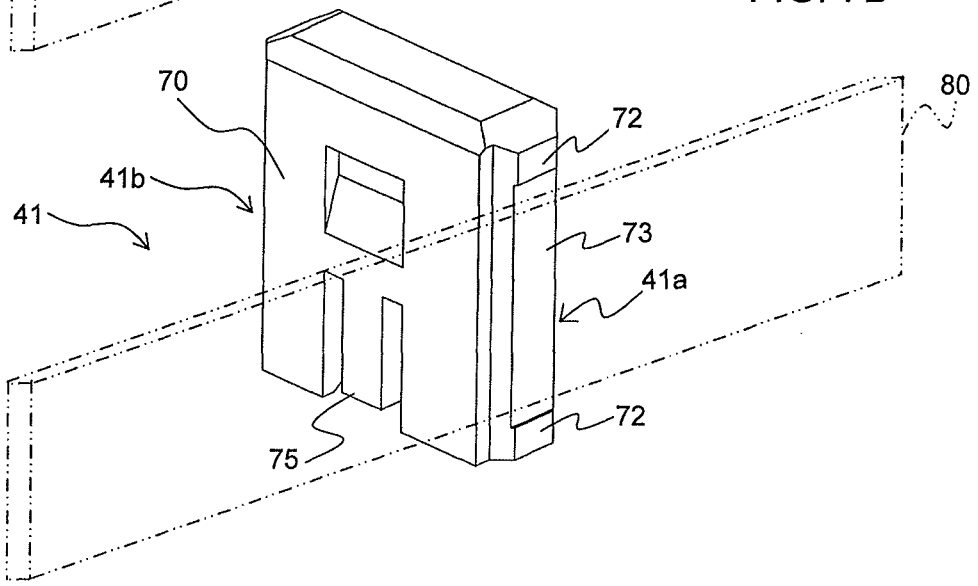
FIG. 7B is a perspective view showing the detailed structure of the cutter blade receiving member.
Figure 8A:
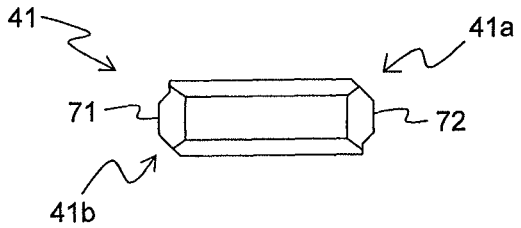
FIG. 8A is a plan view showing the detailed structure of the cutter blade receiving member.
Figure 8C:
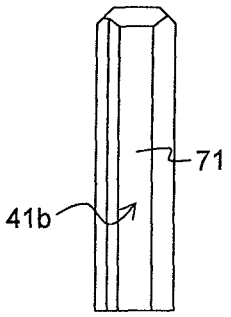
FIG. 8C is a left side view showing the detailed structure of the cutter blade receiving member.
Figure 8B:
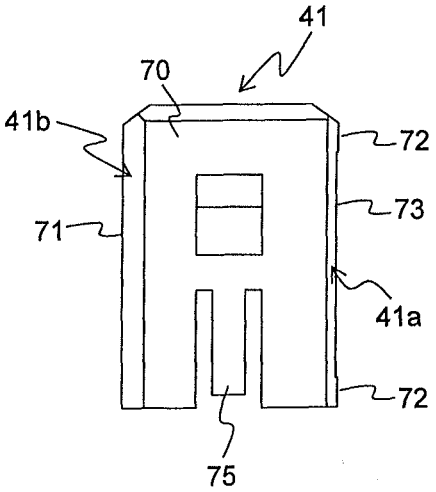
FIG. 8B is a front view showing the detailed structure of the cutter blade receiving member.
Figure 8D:
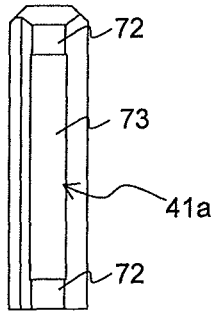
FIG. 8D is a right side view showing the detailed structure of the cutter blade receiving member.
Figure 8E:
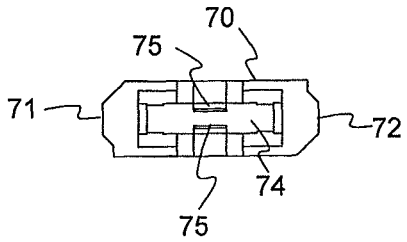
FIG. 8E is a bottom view showing the detailed structure of the cutter blade receiving member.

Then, in this embodiment, the cutter blade receiving member 41 is configured as a single common cutter blade receiving member comprising a first cutter blade receiving part 41*a* on one side (the left rear side in FIG. 7A; the right front side in FIG. 7B), and a second cutter blade receiving part 41*b* on the other side (the right front side in FIG. 7A; the left rear side in FIG. 7B). Then, the cutter blade receiving member 41 is capable of being mounted to the holding portion 76 so that the first cutter blade receiving part 41*a* side faces the feeding path of the label tape 80 with print (refer to FIG. 7B and FIG. 12 described later), and is capable of being mounted to the holding portion 76 so that the second cutter blade receiving part 41*b* side faces the feeding path of the label tape 80 with print (refer to FIG. 7A and FIGS. 11A-11C described later).

Figure 9:
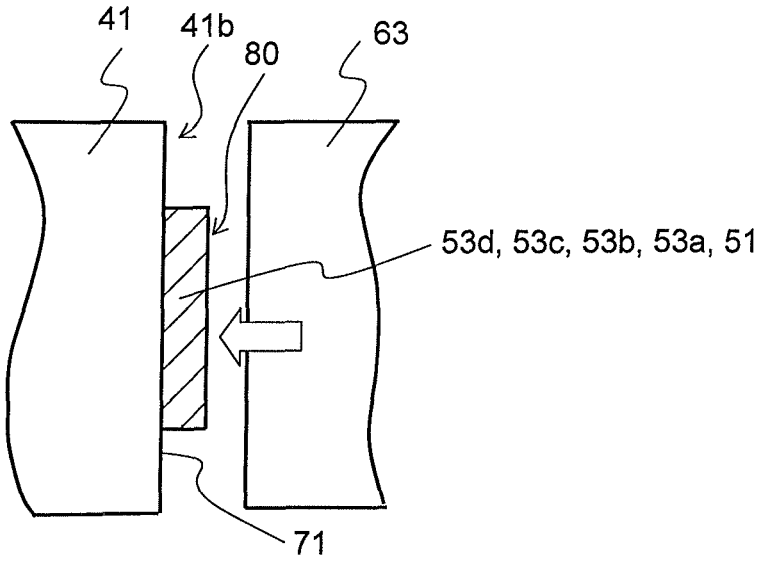
FIG. 9 is a transverse cross-sectional view showing the behavior by which full cutting is performed using the second cutter blade receiving part.

That is, the second cutter blade receiving part 41*b* comprises a second contact portion 71, as shown in FIG. 7A and FIG. 8. This second contact portion 71 is made of resin in this example and, as shown in FIG. 9, receives and stops the contact of the blade edge of the cutter blade 63 while sandwiching the entire tape width of the label tape 80 with print (the cover film 51, the adhesive layer 53*a*, the base film 53*b*, the adhesive layer 53*c*, and the separation sheet 53*d*) at the time of the cutting operation of the above described cutter blade 63. With this arrangement, the cutter blade 63 can fully cut the label tape 80 with print in the thickness direction.

Figure 10:
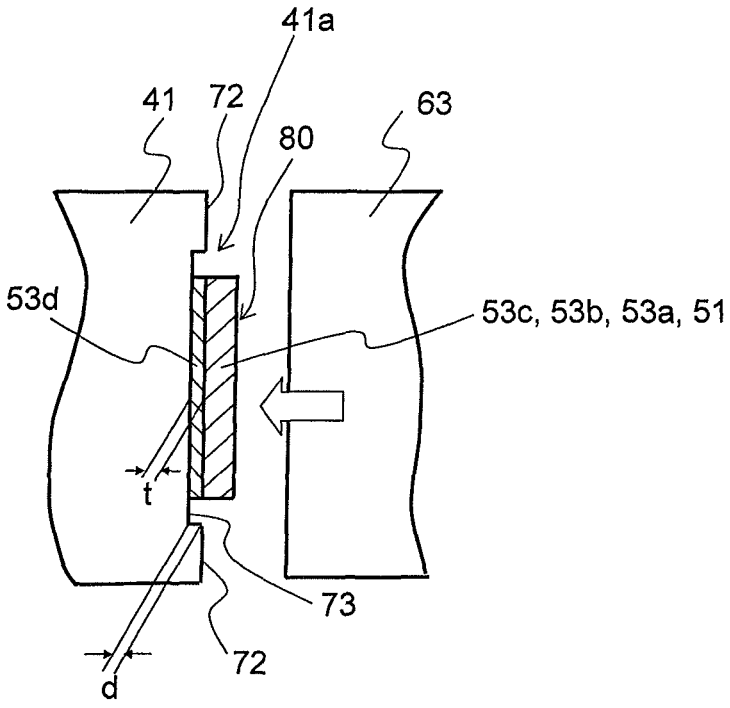
FIG. 10 is a transverse cross-sectional view showing the behavior by which half cutting is performed using the first cutter blade receiving part.

On the other hand, the first cutter blade receiving part 41*a* comprises a concave portion 73 and two first contact portions 72, as shown in FIG. 7B and FIG. 8. At this time, as shown in FIG. 10, the concave portion 73 receives the entire tape width of the cover film 51 in the tape thickness direction. Further, the first contact portions 72 are made of metal in this example and disposed at both side adjacent positions of the concave portion 73 along the tape width direction, respectively receiving and stopping the blade edge of the cutter blade 63. With this arrangement, the blade edge of the cutter blade 63 does not fully arrive up to the entire thickness direction dimension of the label tape 80 with print received by the concave portion 63 of the cover film 51 and, as a result, performs partial cutting (so-called half cutting) in the thickness direction (refer to FIG. 10). In this example, a depth direction dimension d of the concave portion 73 is predetermined to be equivalent to a thickness direction dimension t of the above described separation sheet 53*d*. As a result, the cutter blade 63 can leave the separation sheet 53*d* as is and cut the other sections of the label tape 80 with print (the cover film 51, the adhesive layer 53*a*, the base film 53*b*, and the adhesive layer 53*c*).

Note that the setting of the depth direction dimension d of the concave portion 73 is not limited to the above. The dimension may be smaller than the thickness direction dimension t of the separation sheet 53*d*. In this case, is it possible to partially cut the thickness direction dimension of the separation sheet 53*d* as well. Conversely, the dimension may be larger than the thickness direction dimension t of the separation sheet 53*d*. In this case, it is possible to set the layers of the label tape 80 with print that are to be left as is, that is, the layers of the cover film 51, the adhesive layer 53*a*, the base film 53*b*, and the adhesive layer 53*c* up to which cutting is to be performed and the layers that are to be left as is (with no cutting), to a suitable desired mode based on the setting of the depth direction dimension d.

Full Tape Cutting Operation

Next, the full cutting operation performed on the label tape 80 with print by the cutter blade 63 will be described using FIG. 11A-11C. Note that these FIGS. 11A-11C are equivalent to perspective views of the cutter button 4, the guide holder 40, and the cutter blade receiving member 41 near the tape discharging slit 24, from the rear surface side, with the detachable cover 6B2 removed from the print label producing apparatus 1.

Figure 11A:
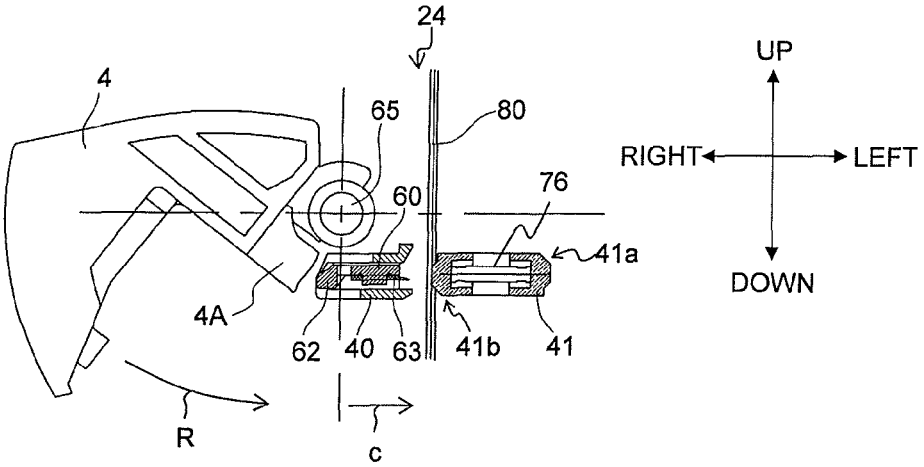
FIG. 11A is an explanatory view explaining the cutting operation of a label tape with print by the cutter blade, showing a state where a pivoting operation has not been performed with respect to the cut lever (initial state).
Figure 11B:
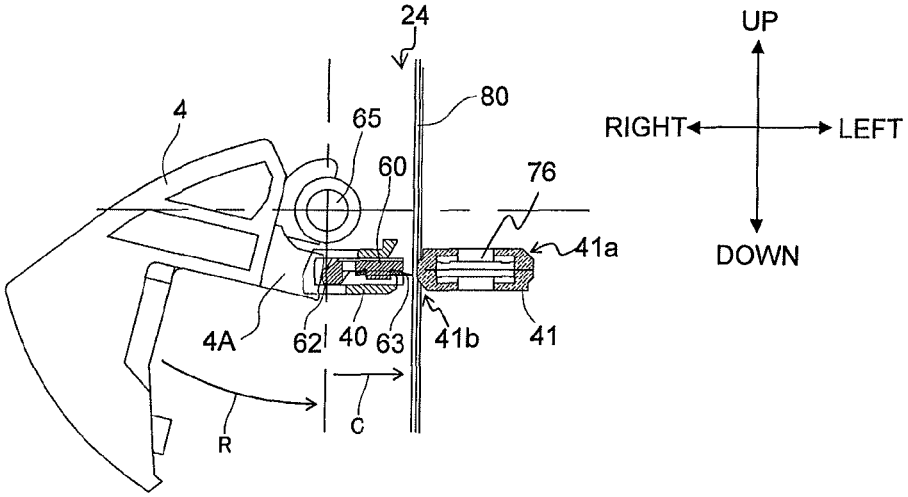
FIG. 11B is an explanatory view explaining the cutting operation of a label tape with print by the cutter blade, showing a state where the leading edge of the cutter blade contacts the label tape with print.
Figure 11C:
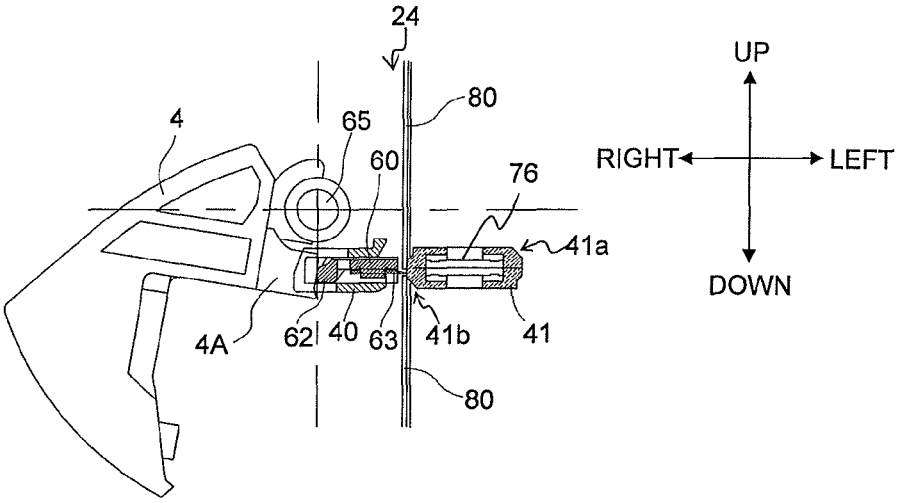
FIG. 11C is an explanatory view explaining the cutting operation of a label tape with print by the cutter blade, showing a state where the leading edge of the cutter blade contacts the cutter blade receiving member.

In FIGS. 11A-11C, in a case where full cutting is to be performed, the operator mounts the cutter blade receiving member 41 to the holding portion 76 so that the second cutter blade receiving part 41*b* is on the feeding path side of the label tape 80 with print as previously described. At this time, as shown in the figures, the cut lever 4 is pivotably supported by the frame 13 with the lever shaft 65 formed on the above described frame 13 serving as the axis. As previously described, the label tape 80 with print discharged from the label tape discharging exit 59 (refer to FIG. 4) is upwardly fed between the guide holder 40 and the cutter blade receiving member 41 along the above described feeding path by the pressure roller 192 (refer to FIG. 4), and the like. Then, the label tape 80 with print is guided to the tape discharging slit 24, and (partially) discharged from the tape discharging slit 24 to outside the print label producing apparatus 1, resulting in the state shown in FIG. 11A.

Then, as shown in FIG. 11A, in the initial state where the pivoting operation of the cut lever 4 has not yet been performed by the operator, the cut lever 4 is positioned in an initial position (the position shown in FIG. 11A). When the cut lever 4 is positioned in this initial position, a contact portion 4A thereof is separated from the above described contacting convex portion 62.

At this time, when the operator performs the pivoting operation of the cut lever 4, the cut lever 4 pivots in a lever rotation direction R with the lever shaft 65 serving as the axis. Then, when the cut lever 4 is pivoted a predetermined amount, the contact portion 4A of the cut lever 4 contacts the above described contacting convex portion 62. Subsequently, when the cut lever 4 is pivoted further in the lever rotation direction R in accordance with the operation of the operator, the above described contact portion 4A causes the cutter holder 60 to move in a direction (leftward direction) of an arrow C orthogonal to the feeding path of the label tape 80 with print, via the contacted contacting convex portion 62. At this time, as the cutter holder 60 moves in the direction of the arrow C, the cutter blade 63 also moves in the direction of the arrow C.

Then, when the cut lever 4 is pivoted further in the lever rotation direction R and the cutter holder 60 moves a predetermined amount in the direction of the arrow C via the above described contact portion 4A and the contacting convex portion 62, the leading edge of the cutter blade 63 contacts the label tape 80 with print (the state shown in FIG. 11B). Subsequently, when the cut lever 4 is pivoted further in the lever rotation direction R, the cutter holder 60 moves further in the direction of the arrow C via the above described contact portion 4A and the contacting convex portion 62. Accordingly, from a state of contact with the label tape 80 with print, the cutter blade 63 gradually presses and cuts the label tape 80 with print by a pressing force (i.e., the force based on the pivoting operation of the cut lever 4) produced between the cutter blade 63 and the cutter blade receiving member 41, eventually contacting the cutter blade receiving member 41 (the state shown in FIG. 11C). With this arrangement, by the pressing force produced between the cutter blade 63 and the cutter blade receiving member 41 based on the pivoting operation of the cut lever 4, the cutter blade 63 can fully press and cut the label tape 80 with print across the entire thickness direction dimension (refer to FIG. 9).

Half Cutting Operation

Figure 12:
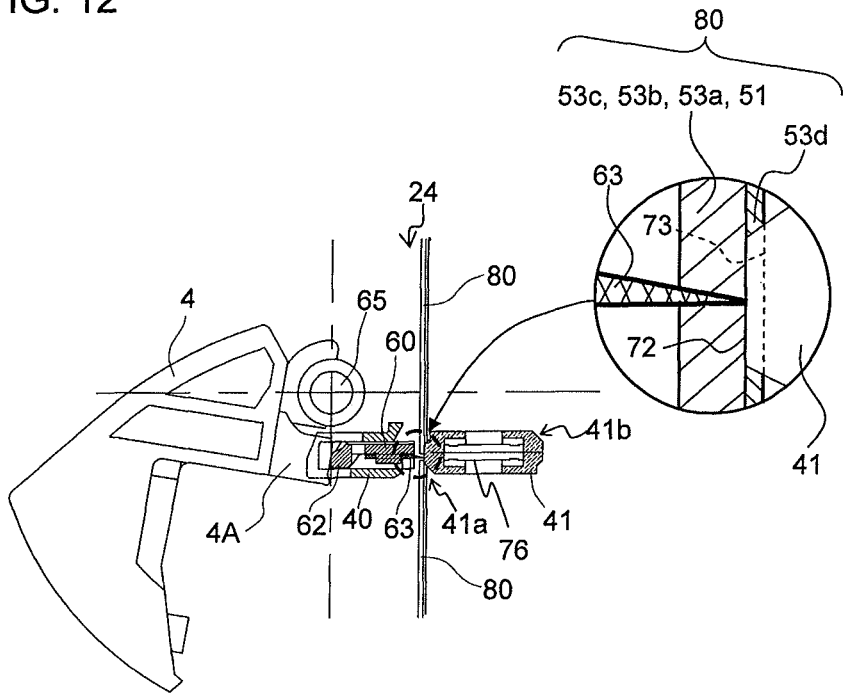
FIG. 12 is an explanatory view explaining the half-cutting operation of the label tape with print by the cutter blade, corresponding to FIG. 11C.

Next, the half cutting operation of the cutter blade 63 will be described using FIG. 12. As shown in FIG. 12, in a case where half cutting is to be performed, the operator mounts the cutter blade receiving member 41 to the holding portion 76 so that the first cutter blade receiving part 41*a* is on the feeding path side of the label tape 80 with print (in an orientation opposite that in the above described FIGS. 11A-11C) as previously described. The operator pivots the cut lever 4 in the lever rotation direction R in the same manner as described using the above described FIGS. 11A-11C, thereby moving the cutter holder 60 in the direction of the arrow C based on the same behavior as described above. At that time, due to the structure of the concave portion 73 of the aforementioned first cutter blade receiving part 41*a*, the label tape 80 with print received and entered into the concave portion 73 is disposed so that it is shifted toward the front side in the direction of travel as viewed from the cutter blade 63. As a result, the leading edge of the cutter blade 63 contacts the label tape 80 with print based on a timing that is further delayed than that during the full cutting of the above described FIGS. 11A-11C (in other words, in the operation amount of the cut lever 4 that is greater than that during full cutting), causing the cutter blade 63 to gradually proceed with the pressing and cutting of the label tape 80 with print. Then, eventually the cutter blade 63 contacts the first contact portion 72 of the first cutter blade receiving part 41*a*. With this arrangement, the cutter blade 63 presses and cuts the sections of the label tape 80 with print excluding the separation sheet 53, that is, the cover film 51, the adhesive layer 53*a*, the base film 53*b*, and the adhesive layer 53*c*, across the entire thickness direction dimension by the pressing force produced between the cutter blade 63 and the cutter blade receiving member 41 (refer to FIG. 10).

Note that, due to the locking structure of the holding portion 76 previously described, when the label tape 80 with print is fully cut or half cut by the above described cutter blade 63, the cutter blade receiving member 41 almost never moves from its given position at any point in time during the cutting operation.

Print Label

An example of print labels L produced while the operator switches the orientation of the cutter blade receiving member 41 as described above will now be described using FIG. 13 and FIG. 14.

Figure 13A:
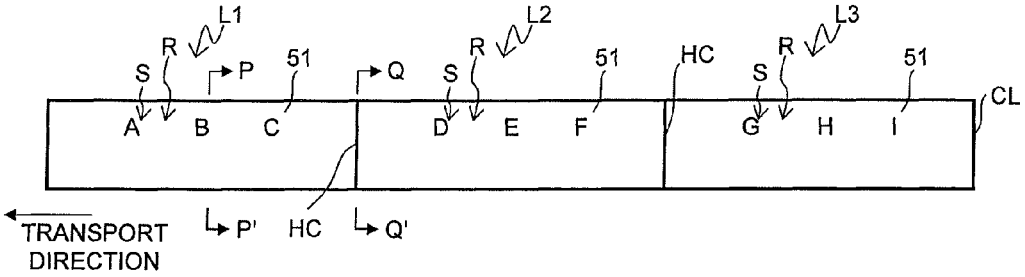
FIG. 13A is a top view showing the outer appearance of an example of a print label continuum formed upon completion of half cutting by the first cutter blade receiving part and full cutting by the second cutter blade receiving part.
Figure 13B:
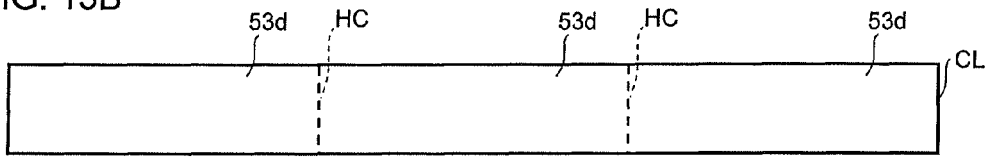
FIG. 13B is a bottom view showing the outer appearance of an example of a print label continuum formed upon completion of half cutting by the first cutter blade receiving part and full cutting by the second cutter blade receiving part.
Figure 14A:
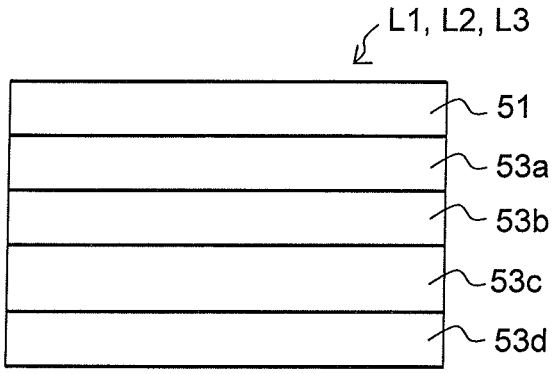
FIG. 14A is a transverse cross-sectional view taken along line P-P' in FIG. 13.
Figure 14B:
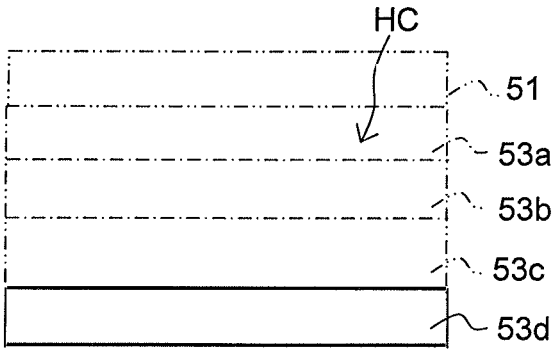
FIG. 14B is a transverse cross-sectional view taken along line Q-Q' in FIG. 13.

Then, in FIG. 13A and FIG. 13B, the print label continuum made of three print labels L1, L2, and L3 in this example is produced. These print labels L1, L2, and L3 are formed upon the completion of the cutting or half cutting of the label tape 80 with print as described above, and are designed with a five-layer structure with the cover film 51 added to the four-layer structure shown in the aforementioned FIG. 4 (refer to FIG. 14A). That is, the label L is configured with five layers including the cover film 51, the adhesive layer 53*a*, the base film 53*b*, the adhesive layer 53*c*, and the separation sheet 53*d*, from the cover film 51 side (the upper side in FIG. 14A) to the opposite side (the lower side in FIG. 14A). Then, a print R is printed on the respective rear surfaces of the cover film 51.

In this example, when the print label continuum is produced, the cutter blade receiving member 41 is mounted so that the first cutter blade receiving part 41*a* is on the feeding path side of the label tape 80 with print, setting the state to one where the cutter blade 63 performs half cutting, and the print label L1 comprising the print R of "ABC" and the print label L2 comprising the print R of "DEF" are produced. With this arrangement, the rear end on the upstream side in the transport direction (the right side in the figure) of the print label L1 (in other words, the boundary part with the print label L2) forms a half-cut part HC wherein all sections of the label tape 80 with print excluding the separation sheet 53, that is, the cover film 51, the adhesive layer 53*a*, the base film 53*b*, and the adhesive layer 53*c*, are divided (refer to FIG. 14B), which is the result of the above described half cutting. The same also holds true for the rear end on the upstream side in the transport direction of the print label L2 (in other words, the boundary part with the print label L3).

Then, after the above, the cutter blade receiving member 41 is switched so that the second cutter blade receiving part 41*b* is on the feeding path side of the label tape 80 with print, setting the state to one where the cutter blade 63 performs half cutting, and the print label L3 comprising the print R of "GHI" is produced. With this arrangement, the rear end on the upstream side in the transport direction of the print label L3 (in other words, the rear end of the print label continuum) forms a full-cut line CL wherein all layers of the label tape 80 with print are divided, which is the result of the above described full cutting.

As described above, in the print label producing apparatus 1 of this embodiment, the label tape 80 with print is cut to a predetermined length by the coordinated operation of the cutter blade 63 and the cutter blade receiving member 41, thereby producing the print label L comprising the desired print R.

At that time, the cutter blade receiving member 41 is freely detachably configured with respect to the holding portion 63. Mounting the cutter blade receiving member 41 to the holding portion 63 so that the second cutter blade receiving part 41*b* faces the feeding path side of the label tape 80 with print makes it possible to fully cut the label tape 80 with print. Mounting the cutter blade receiving member 41 to the holding portion 63 so that the first cutter blade receiving part 41*a* faces the feeding path side of the label tape 80 with print makes it possible to half cut the label tape 80 with print. That is, by simply switching the cutter blade receiving member 41 mounted to the holding portion 76 to the opposite orientation, it is possible to execute both full cutting and cutting of a desired mode (half cutting in this example) using the same single cutter blade 63. With this arrangement, compared to the prior art structure which requires provision of both a cutting device for full cutting and a cutting device for desired cutting, it is possible to decrease the size as well as the manufacturing costs of the apparatus.

Further, in particular, according to this embodiment, the cutting mode can be switched by simply switching the orientation of the single common cutter blade receiving member 41, making it possible to decrease the number of parts and improve handling performance to a greater degree than a case where two cutter blade receiving members, namely a cutter blade receiving member equivalent to the first cutter blade receiving part 41*a* and a cutter blade receiving member equivalent to the second cutter blade receiving part 41*b* are separately prepared (refer to modification (4) described later).

Further, according to this embodiment, the first contact portion 72 of the first cutter blade receiving part 41*a* in particular is made of metal, making it possible to avoid the occurrence of wear and tear on the first contact portion 72, which can occur in a case where it is made of resin, etc. Note, however, in this case, due to the above described receiving and stopping of the blade edge by the first contact portion 72, wear and tear occur on the section of the blade edge of the cutter blade 63 which is received and stopped by the above described first contact portion 72. Nevertheless, as described above, since the first contact portion 72 is provided further on both sides in the tape width direction than the concave portion 73 that receives the entire width of the label tape 80 with print, the section of the blade edge of the cutter blade 63 where the above described wear and tear occur is a section that does not contribute to the full cutting of the label tape 80 with print in the thickness direction. Accordingly, even if wear and tear occur, they do not cause any problems in terms of the cutting function of the cutter blade 63. Further, the second contact portion 71 is made of resin, minimizing damage to the blade edge of the cutter blade 63 during the above described full cutting. As a result of the above, it is possible to avoid wear and tear on the first cutting blade receiving member while maintaining the cutting performance of the cutter blade 63.

Note that the present disclosure is not limited to the above described embodiment, and various modifications may be made without deviating from the spirit and scope of the disclosure. Description will be made below regarding such modifications.

Figure 15:
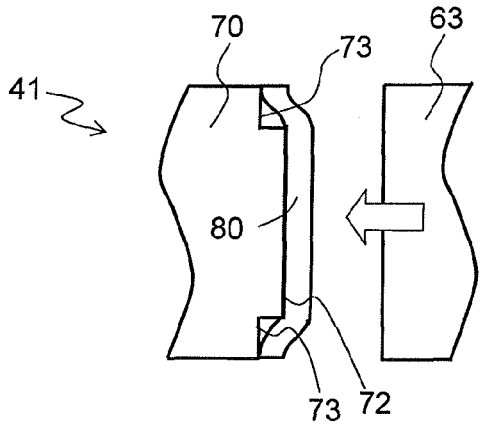
FIG. 15 is a conceptual cross-sectional view showing the behavior when desired cutting is performed using the first cutter blade receiving part in a modification where both tape width direction ends are left as is and only the center side is cut.
Figure 16:
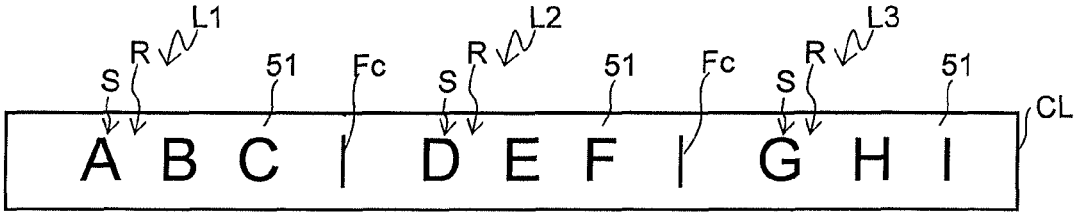
FIG. 16 includes a top view and a bottom view showing the outer appearance of an example of a print label continuum formed upon completion of desired cutting by the first cutter blade receiving part and full cutting by the second cutter blade receiving part.

(1) When Performing Desired Cutting that Leaves Both Tape Width Direction Ends as is and Cuts the Center Side Only In this modification, as shown in FIG. 15, the first cutter blade receiving part 41*a* comprises one first contact portion 72 at the center, and two concave portions 73 on both tape width direction sides respectively adjacent to both tape width direction sides of this first contact portion 72. The concave portion 73 receives a part of the entire tape width (both tape width direction end sections in this example) of the label tape 80 with print in the tape thickness direction. Further, in this example, the depth direction dimension of the concave portion 73 is formed equivalent to (or deeper than) the thickness direction dimension of the label tape 80 with print. As a result, in a case where the first cutter blade receiving part 41*a* is disposed at the holding portion 76 facing the feeding path side of the label tape 80 with print, the blade edge of the cutter blade 63 does not arrive at the section of the label tape 80 with print that is positioned inside the concave portion 73, resulting in no cutting (refer to FIG. 16). On the other hand, the first contact portion 72 receives and stops the blade edge of the cutter blade 63 in the same manner as described above, causing the cutter blade 63 to fully cut the area of the label tape 80 with print corresponding to the first contact portion 72 in the thickness direction.

In this example, when the print label continuum is produced, the cutter blade receiving member 41 is mounted so that the first cutter blade receiving part 41*a* is on the feeding path side of the label tape 80 with print, setting the state to one where the cutter blade 63 performs the above described desired cutting, and the print label L1 comprising the print R of "ABC" and the print label L2 comprising the print R of "DEF" are produced. With this arrangement, as a result of the above described desired cutting, the rear end on the upstream side in the transport direction (right side in the figure) of the print label L1 (in other words, the boundary part with the print label L2) forms the slit-shaped full-cut part FC on the center side only, leaving both tape width direction ends as is. The same also holds true for the rear end on the upstream side in the transport direction of the print label L2 (in other words, the boundary part with the print label L3).

Then, after the above, the cutter blade receiving member 41 is switched so that the second cutter blade receiving part 41*b* is on the feeding path side of the label tape 80 with print, setting the state to one where the cutter blade 63 performs half cutting, and the print label L3 comprising the print R of "GHI" is produced. With this arrangement, the rear end on the upstream side in the transport direction of the print label L3 (in other words, the rear end of the print label continuum) forms a full-cut line CL wherein all layers of the label tape 80 with print are divided, which is the result of the above described full cutting.

In this modification as well, the same advantages as those of the above described embodiment are achieved. That is, the label tape 80 with print can be fully cut by mounting the cutter blade receiving member 41 to the holding portion 63 so that the second cutter blade receiving part 41*b* faces the feeding path side of the label tape 80 with print. Further, the above described desired cutting can be performed on the label tape 80 with print by mounting the cutter blade receiving member 41 to the holding portion 63 so that the first cutter blade receiving part 41 a faces the feeding path side of the label tape 80 with print. That is, by simply switching the cutter blade receiving member 41 mounted to the holding portion 76 to the opposite orientation, it is possible to execute both full cutting and desired cutting (leaving both tape width direction ends as is and cutting the center side only in this example) using the same single cutter blade 63.

Figure 17:
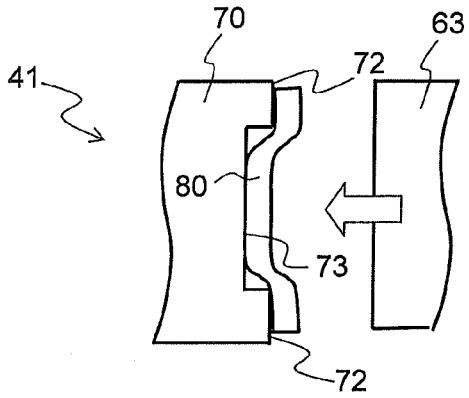
FIG. 17 is a conceptual cross-sectional view showing the behavior when desired cutting is performed using the first cutter blade receiving part in a modification where the tape width direction center side is left as is and only both ends are cut.
Figure 18:
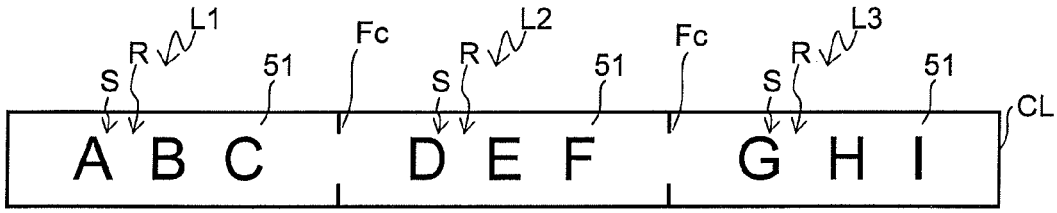
FIG. 18 includes a top view and a bottom view showing the outer appearance of an example of a print label continuum formed upon completion of desired cutting by the first cutter blade receiving part and full cutting by the second cutter blade receiving part.

(2) When Performing Desired Cutting that Leaves the Tape Width Direction Center Side as is and Cuts Both Ends Only In this modification, as shown in FIG. 17, the first cutter blade receiving part 41*a* comprises one concave portion 73 at the center, and two first contact portions 72 on both tape width direction sides respectively adjacent to both tape width direction sides of this concave portion 73. The concave portion 73 receives a part of the entire tape width (in this example, the tape width direction center) of the label tape 80 with print in the tape thickness direction. Further, the depth direction dimension of the concave portion 73, in this example as well, is formed equivalent to (or deeper than) the thickness direction dimension of the label tape 80 with print in the same manner as described above. As a result, in a case where the first cutter blade receiving part 41*a* is disposed at the holding portion 76 facing the feeding path side of the label tape 80 with print, the blade edge of the cutter blade 63 does not arrive at the section of the label tape 80 with print that is positioned inside the concave portion 73, resulting in no cutting (refer to FIG. 18). On the other hand, the first contact portion 72 receives and stops the blade edge of the cutter blade 63 in the same manner as described above, causing the cutter blade 63 to fully cut the area of the label tape 80 with print corresponding to the first contact portion 72 (both tape width direction ends) in the thickness direction.

In this example as well, the cutter blade receiving member 41 is mounted so that the first cutter blade receiving part 41*a* is on the feeding path side of the label tape 80 with print in the same manner as described above, and the print labels L1 and L2 respectively comprising the print R of "ABC" and the print R of "DEF" are produced. With this arrangement, as a result of the above described desired cutting, the rear end on the upstream side in the transport direction (right side in the figure) of the print label L1 (in other words, the boundary part with the print label L2) forms the slit-shaped full-cut part FC on both ends only, leaving the tape width direction center side as is. The same also holds true for the rear end on the upstream side in the transport direction of the print label L2 (in other words, the boundary part with the print label L3).

Subsequently, the production of the print label L3 comprising the print R of "GHI" is the same as described above, and the description thereof is omitted.

In this modification as well, the above described desired cutting can be performed on the label tape 80 with print by mounting the cutter blade receiving member 41 so that the first cutter blade receiving part 41*a* faces the feeding path side in the same manner as described above. Accordingly, it is possible to execute both full cutting and desired cutting (in this example, leaving the tape width direction center side as is and cutting both ends only) using the same single cutter blade 63.

Figure 19:
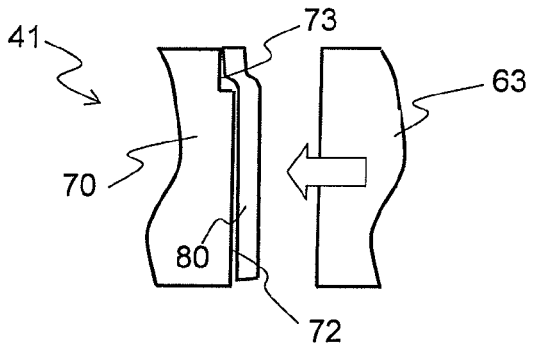
FIG. 19 is a conceptual cross-sectional view showing the behavior when desired cutting is performed using the first cutter blade receiving part in a modification where one side tape width direction end is left as is and the remaining areas are cut.
Figure 20:
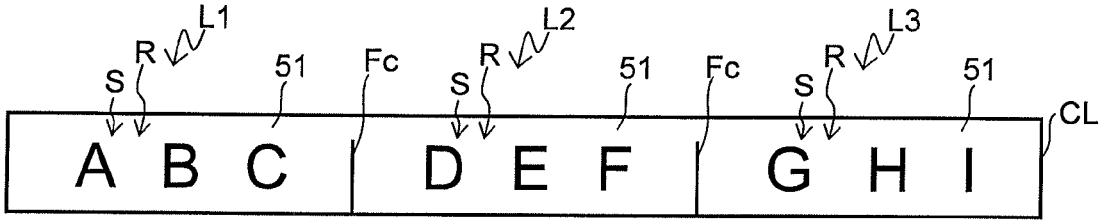
FIG. 20 includes a top view and a bottom view showing the outer appearance of an example of a print label continuum formed upon completion of desired cutting by the first cutter blade receiving part and full cutting by the second cutter blade receiving part.

(3) When Performing Desired Cutting that Leaves One Tape Width Direction Side End as is and Cuts All Remaining Parts In this modification, as shown in FIG. 19, the first cutter blade receiving part 41*a* comprises one concave portion 73 corresponding to one side end along the tape width direction, and one first contact portion 72 adjacent to the other side of this concave portion 73 along the tape width direction. The concave portion 73 receives a part of the entire tape width (in this example, one tape width direction side end) of the label tape 80 with print in the tape thickness direction. Further, the depth direction dimension of the concave portion 73, in this example as well, is formed equivalent to (or deeper than) the thickness direction dimension of the label tape 80 with print in the same manner as described above. As a result, in a case where the first cutter blade receiving part 41*a* is disposed at the holding portion 76 facing the feeding path side of the label tape 80 with print, the blade edge of the cutter blade 63 does not arrive at the section of the label tape 80 with print that is positioned inside the concave portion 73, resulting in no cutting (refer to FIG. 20). On the other hand, the first contact portion 72 receives and stops the blade edge of the cutter blade 63 in the same manner as described above, causing the cutter blade 63 to fully cut the area of the label tape 80 with print corresponding to the first contact portion 72 (the area other than the one tape width direction side end) in the thickness direction.

In this example as well, the cutter blade receiving member 41 is mounted so that the first cutter blade receiving part 41*a* is on the feeding path side of the label tape 80 with print in the same manner as described above, and the print labels L1 and L2 respectively comprising the print R of "ABC" and the print R of "DEF" are produced. With this arrangement, as a result of the above described desired cutting, the rear end on the upstream side in the transport direction (right side in the figure) of the print label L1 (in other words, the boundary part with the print label L2) forms the slit-shaped full-cut part FC on all areas other than one tape width direction side end, leaving the one tape width direction side end as is. The same also holds true for the rear end on the upstream side in the transport direction of the print label L2 (in other words, the boundary part with the print label L3).

Subsequently, the production of the print label L3 comprising the print R of "GHI" is the same as described above, and the description thereof is omitted.

In this modification as well, the above described desired cutting can be performed on the label tape 80 with print by mounting the cutter blade receiving member 41 so that the first cutter blade receiving part 41*a* faces the feeding path side in the same manner as described above. Accordingly, it is possible to execute both full cutting and desired cutting (in this example, leaving the one tape width direction side end as is and cutting all remaining areas) using the same single cutter blade 63.

Figure 21A:
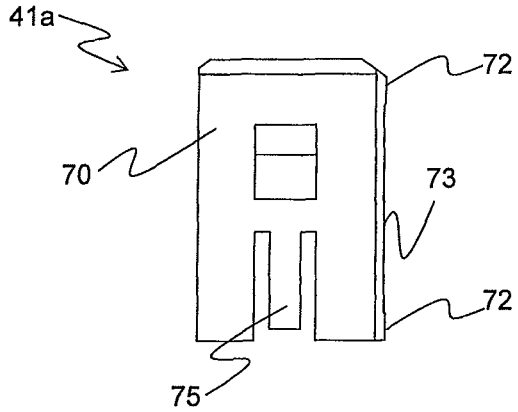
FIG. 21A is a front view of the first cutter blade receiving member in a modification where two types of cutter blade receiving members are prepared, exchanged, and used.
Figure 21B:
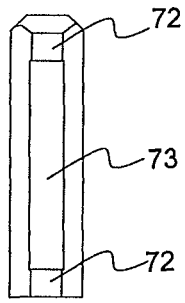
FIG. 21B is a side view of the first cutter blade receiving member in a modification where two types of cutter blade receiving members are prepared, exchanged, and used.
Figure 21C:
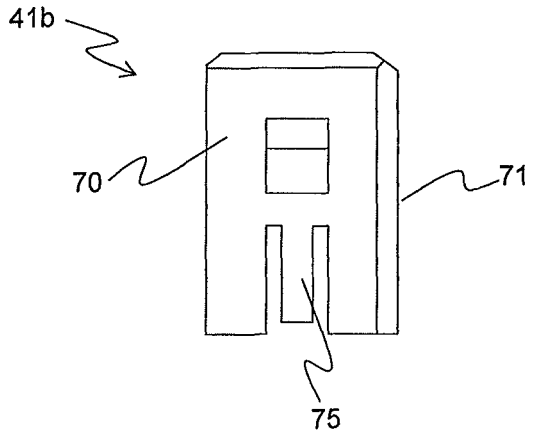
FIG. 21C is a front view of the second cutter blade receiving member in a modification where two types of cutter blade receiving members are prepared, exchanged, and used.
Figure 21D:
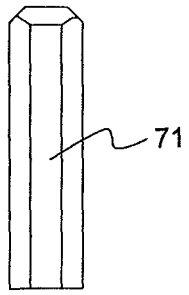
FIG. 21D is a side view of the second cutter blade receiving member in a modification where two types of cutter blade receiving members are prepared, exchanged, and used.

(4) When Preparing, Exchanging, and Using Two Types of Cutter Blade Receiving Members That is, while in the above the single common cutter blade receiving member 41 comprises the first cutter blade receiving part 41*a* for desired cutting and the second cutter blade receiving part 41*b* for full cutting, the present disclosure is not limited thereto. That is, as shown in FIG. 21A and FIG. 21B, both a first cutter blade receiving member 41A comprising the first contact portion 72 and the concave portion 73 and a second cutter blade receiving member 41B comprising the second contact portion 71 may be provided so that these are selectively mounted to the holding portion 63.

In this modification, the label tape 80 with print can be fully cut by mounting the second cutter blade receiving member 41B to the holding portion 63 (so that the second contact portion 71 faces the feeding path side of the label tape 80 with print). Further, the label tape 80 with print can be half cut by mounting the first cutter blade receiving member 41A to the holding portion 63 (so that the first contact portion 72 and the concave portion 73 face the feeding path side of the label tape 80 with print). That is, by replacing the cutter blade receiving members 41A and 41B mounted to the holding portion 76, it is possible to execute both full cutting and cutting of a desired mode (half cutting in this example) using the same single cutter blade 63. With this arrangement, compared to the prior art structure which requires provision of both a cutting device for full cutting and a cutting device for desired cutting, it is possible to decrease the size as well as the manufacturing costs of the apparatus.

Note that, in this modification, an engaging portion 76' capable of locking a cutter blade receiving member 41' of the two cutter blade receiving members types, namely the first cutter blade receiving member and the second cutter blade receiving member, that is not mounted to the holding portion 76 may be disposed at a suitable location (refer to the imaginary line of FIG. 3), for example. The example shown is one where the engaging portion 76' of FIG. 3 is disposed at the frame 13. The provision of a storage location of the cutter blade receiving member 41' not mounted to the holding portion 76 in this manner has the effect of preventing the loss of the cutter blade receiving member 41' and improving the integrated handling performance of the print label producing apparatus 1 main body.

(5) Other

While the above employs a method wherein printing is performed on the cover film 51 separate from the base tape 53 and then the two are bonded together, the present disclosure is not limited thereto. For example, the present disclosure may also be applied to a method (a type that does not perform bonding) wherein printing is performed on the print-receiving tape layer disposed at the base tape.

Further, other than that already stated above, techniques based on the above described embodiments and each of the modifications may be suitably utilized in combination as well.

What is claimed is:

1. A print label producing apparatus comprising:

a print label producing apparatus main body; and at least one cutting blade receiving member configured to receive and stop a cutting blade when a print-receiving tape is cut by said cutting blade, said print label producing apparatus main body comprising:

a feeder configured to feed said print-receiving tape along a feeding path;

a printing head configured to perform desired printing on said print-receiving tape fed by said feeder;

said cutting blade configured to move along a direction orthogonal to said feeding path and press and cut said print-receiving tape after printing; and a holding portion configured to attach and detach said cutting blade receiving member, and said at least one cutting blade receiving member comprises:

a first cutting blade receiving member comprising at least one concave portion configured to receive at least a part of an entire tape width of said print-receiving tape in a tape thickness direction, and a first contact portion configured to receive and stop contact of a blade edge of said cutting blade at an adjacent position, disposed at said adjacent position along said tape width direction from said concave portion;

a second cutting blade receiving member comprising a second contact portion configured to receive and stop contact of the blade edge of said cutting blade while sandwiching the entire tape width of said print-receiving tape, a hook disposed on one of said first cutting blade receiving member or said second cutting blade receiving member; wherein said holding portion of said print label producing apparatus main body comprises a locking hole configured to selectively engage with said hook disposed on one of said first cutting blade receiving member or said second cutting blade receiving member and is configured to permit selective mounting of one of said first cutting blade receiving member and said second cutting blade receiving member by means of said locking hole.

2. The print label producing apparatus according to claim 1, wherein:

said first cutting blade receiving member comprises one said concave portion configured to receive the entire tape width of said print-receiving tape in the tape thickness direction, disposed at a center side along said tape width direction, and said first contact portion configured to receive and stop contact of the blade edge of said cutting blade, provided adjacent to both sides of said concave portion along said tape width direction, and said cutting blade of said print label producing apparatus main body is configured to fully cut said print-receiving tape in the thickness direction in a case where said second cutting blade receiving member is mounted to said holding portion, and to partially cut said print-receiving tape in the thickness direction in a case where said first cutting blade receiving member is mounted to said holding portion.

3. The print label producing apparatus according to claim 1, wherein:

said first cutting blade receiving member comprises two said concave portions configured to receive both ends of said print-receiving tape along the tape width direction in the tape thickness direction, disposed at both ends along said tape width direction, and one said first contact portion configured to receive and stop contact of the blade edge of said cutting blade, disposed at a middle area of said two concave portions along said tape width direction, and said cutting blade of said print label producing apparatus main body is configured to partially cut both width direction ends of said print-receiving tape in the thickness direction and to fully cut a middle area between said both width direction ends in the thickness direction in a case where said first cutting blade receiving member is mounted to said holding portion.

4. The print label producing apparatus according to claim 1, wherein:

said first cutting blade receiving member comprises one said concave portion configured to receive a middle area of said print-receiving tape along the tape width direction in the tape thickness direction, disposed at a middle area along said tape width direction, and two said first contact portions configured to respectively receive and stop contact of the blade edge of said cutting blade, disposed at both ends along the tape width direction adjacent to both sides of said one concave portion in said tape width direction, and said cutting blade of said print label producing apparatus main body is configured to fully cut both width direction ends of said print-receiving tape in the thickness direction and to partially cut a middle area between said both width direction ends in the thickness direction in a case where said first cutting blade receiving member is mounted to said holding portion.

5. The print label producing apparatus according to claim 1, wherein:

said first cutting blade receiving member comprises one said concave portion configured to receive one side end of said print-receiving tape along the tape width direction in the tape thickness direction, disposed at one side end along said tape width direction, and one said first contact portion configured to receive and stop contact of the blade edge of said cutting blade, provided adjacent to the other side of said one concave portion along said tape width direction so as to extend up to the other side end of said print-receiving tape along the tape width direction, and said cutting blade of said print label producing apparatus main body is configured to partially cut said width direction one side end of said print-receiving tape in the thickness direction and to fully cut the section other than said width direction one side end in the thickness direction in a case where said first cutting blade receiving member is mounted to said holding portion.

6. The print label producing apparatus according to claim 2, wherein:

said first contact portion of said first cutting blade receiving member of said print label producing apparatus main body is made of metal; and said second contact portion of said second cutting blade receiving member is made of resin.

7. A print label producing apparatus comprising:

a print label producing apparatus main body; and at least one cutting blade receiving member configured to receive and stop a cutting blade when a print-receiving tape is cut by said cutting blade, said print label producing apparatus main body comprising:

a feeder configured to feed said print-receiving tape along a feeding path;

a printing head configured to perform desired printing on said print-receiving tape fed by said feeder;

said cutting blade configured to move along a direction orthogonal to said feeding path and press and cut said print-receiving tape after printing; and a holding portion configured to attach and detach said cutting blade receiving member, and said at least one cutting blade receiving member comprises:

a first cutting blade receiving member comprising at least one concave portion configured to receive at least a part of an entire tape width of said print-receiving tape in a tape thickness direction, and a first contact portion configured to receive and stop contact of a blade edge of said cutting blade at an adjacent position, disposed at said adjacent position along said tape width direction from said concave portion; and a second cutting blade receiving member comprising a second contact portion configured to receive and stop contact of the blade edge of said cutting blade while sandwiching the entire tape width of said print-receiving tape, and said holding portion of said print label producing apparatus main body is configured to permit selective mounting of one of said first cutting blade receiving member and said second cutting blade receiving member, wherein:

said first cutting blade receiving member and said second cutting blade receiving member are configured as a single common cutting blade receiving member comprising said first cutting blade receiving member on one side and said second cutting blade receiving member on the other side.

8. The print label producing apparatus according to claim 1, further comprising:

an engaging portion configured to engage one cutting blade receiving member of said first cutting blade receiving member and said second cutting blade receiving member, the one cutting blade receiving member being not mounted to said holding portion.

9. The print label producing apparatus according to claim 7, wherein:

said first cutting blade receiving member comprises one said concave portion configured to receive the entire tape width of said print-receiving tape in the tape thickness direction, disposed at a center side along said tape width direction, and said first contact portion configured to receive and stop contact of the blade edge of said cutting blade, provided adjacent to both sides of said concave portion along said tape width direction, and said cutting blade of said print label producing apparatus main body is configured to fully cut said print-receiving tape in the thickness direction in a case where said second cutting blade receiving member is mounted to said holding portion, and to partially cut said print-receiving tape in the thickness direction in a case where said first cutting blade receiving member is mounted to said holding portion.

10. The print label producing apparatus according to claim 7, wherein:

said first cutting blade receiving member comprises two said concave portions configured to receive both ends of said print-receiving tape along the tape width direction in the tape thickness direction, disposed at both ends along said tape width direction, and one said first contact portion configured to receive and stop contact of the blade edge of said cutting blade, disposed at a middle area of said two concave portions along said tape width direction, and said cutting blade of said print label producing apparatus main body is configured to partially cut both width direction ends of said print-receiving tape in the thickness direction and to fully cut a middle area between said both width direction ends in the thickness direction in a case where said first cutting blade receiving member is mounted to said holding portion.

11. The print label producing apparatus according to claim 7, wherein:

said first cutting blade receiving member comprises one said concave portion configured to receive a middle area of said print-receiving tape along the tape width direction in the tape thickness direction, disposed at a middle area along said tape width direction, and two said first contact portions configured to respectively receive and stop contact of the blade edge of said cutting blade, disposed at both ends along the tape width direction adjacent to both sides of said one concave portion in said tape width direction, and said cutting blade of said print label producing apparatus main body is configured to fully cut both width direction ends of said print-receiving tape in the thickness direction and to partially cut a middle area between said both width direction ends in the thickness direction in a case where said first cutting blade receiving member is mounted to said holding portion.

12. The print label producing apparatus according to claim 7, wherein:

said first cutting blade receiving member comprises one said concave portion configured to receive one side end of said print-receiving tape along the tape width direction in the tape thickness direction, disposed at one side end along said tape width direction, and one said first contact portion configured to receive and stop contact of the blade edge of said cutting blade, provided adjacent to the other side of said one concave portion along said tape width direction so as to extend up to the other side end of said print-receiving tape along the tape width direction, and said cutting blade of said print label producing apparatus main body is configured to partially cut said width direction one side end of said print-receiving tape in the thickness direction and to fully cut the section other than said width direction one side end in the thickness direction in a case where said first cutting blade receiving member is mounted to said holding portion.

13. The print label producing apparatus according to claim 9, wherein:

said first contact portion of said first cutting blade receiving member of said print label producing apparatus main body is made of metal; and said second contact portion of said second cutting blade receiving member is made of resin.

14. The print label producing apparatus according to claim 7, further comprising:

an engaging portion configured to engage one cutting blade receiving member of said first cutting blade receiving member and said second cutting blade receiving member, the one cutting blade receiving member being not mounted to said holding portion.

* * * * *